US007134443B1

(12) United States Patent
Shires

(10) Patent No.: US 7,134,443 B1
(45) Date of Patent: Nov. 14, 2006

(54) LIGHTWEIGHT ARCH-SUPPORTED SHELTER

(76) Inventor: Henry C. Shires, 330 Belmont Ave., Redwood City, CA (US) 94061

( * ) Notice: Subject to any disclaimer, the term of this patent is extended or adjusted under 35 U.S.C. 154(b) by 467 days.

(21) Appl. No.: 10/673,286

(22) Filed: Sep. 30, 2003

(51) Int. Cl.
*E04H 15/36* (2006.01)
*E04H 15/58* (2006.01)

(52) U.S. Cl. ..... 135/124; 135/128; 135/117; 135/87

(58) Field of Classification Search ..... 135/117, 135/87, 90, 123–126, 128
See application file for complete search history.

(56) References Cited

U.S. PATENT DOCUMENTS 785,582 A * 3/1905 Stemple ..... 135/90
1,057,628 A * 4/1913 Eberhardt ..... 135/97
1,215,139 A * 2/1917 Gail ..... 2/89
2,567,697 A * 9/1951 Craighead, Jr. et al ..... 135/90
2,742,912 A * 4/1956 Blanchard ..... 135/94
3,060,949 A * 10/1962 Moss ..... 135/87
3,240,217 A * 3/1966 Bird et al. ..... 135/123
3,675,667 A * 7/1972 Miller ..... 135/126
3,800,814 A * 4/1974 Hibbert ..... 135/93
3,970,096 A * 7/1976 Nicolai ..... 135/94
4,198,997 A * 4/1980 Miller ..... 135/90
4,719,934 A 1/1988 Mydans
4,719,935 A * 1/1988 Gustafson ..... 135/124
5,662,134 A * 9/1997 Auer ..... 135/156
5,915,400 A * 6/1999 Pohl et al. ..... 135/125
6,152,461 A * 11/2000 Dunks ..... 280/30
6,454,340 B1 * 9/2002 Miller et al. ..... 296/104
6,742,533 B1 * 6/2004 Olson ..... 135/95
2001/0042563 A1 11/2001 Coupounas
2003/0221716 A1 * 12/2003 Olson ..... 135/95

OTHER PUBLICATIONS

Shires, Ultralight Shelters (About Tarptent), webpage, 2003 (referring to 1999 and 2002 products), 2 pages.
Shires, Ultralight Shelters (Henry's Original Tarptent and Tarptent-for-2), webpage article, last update Sep. 5, 2001, 19 pages.
Stephenson's Warmlite, "Warmlite Tents", webpage, date unknown but published tent designs believed 2002 or earlier, 7 pages, U.S.
Hilleberg, Hilleberg 2003 Catalog (English), 2003, 47 pages, U.S.

* cited by examiner

*Primary Examiner*—Robert Canfield
(74) *Attorney, Agent, or Firm*—Northern Michigan Patent Law, PLC

(57) ABSTRACT

A nominally floorless hikers' shelter having a raised, tensioned waterproof canopy supported off the ground by pole supports at the front and rear, in which the canopy has a catenary curved ridgeline tensioned between a higher vertical front arch support and a lower, outwardly-angled rear arch support. The shelter is longitudinally tensioned through front and rear awnings extending from the front and rear arch supports. The front awning includes a novel guyline tensioning and ventilation structure in which spaced parallel guylines are attached to the awning at circumferentially spaced locations between the arch support and the lower edge of the awning, leaving an unbroken web of fabric tensioning the arch, and allowing lower portions of the awning to be selectively rolled up for ventilation. The shelter preferably has a hanging insect netting perimeter, including front and rear door panels and sidewalls.

20 Claims, 6 Drawing Sheets

LIGHTWEIGHT ARCH-SUPPORTED SHELTER

FIELD OF THE INVENTION

The present invention is in the field of tent and tarp type shelters used by hikers and campers.

BACKGROUND OF THE INVENTION

Hikers and campers, especially backpackers, usually require a shelter such as a tent for overnight or multi-night trips. The longer the trip, the greater the need for a shelter of as little packed weight as possible to reduce fatigue, to make room for food and other gear, and to increase the enjoyment of hiking.

Tents tend to be one of the heaviest items in the pack, and many hikers opt for lighter, less-protective tarps or floorless shelters such as nylon pyramids for the weight savings alone. Even "single-wall" tents, with only one layer of waterproof canopy fabric rather than spaced layers of breathable and waterproof fabric, tend to be heavier than tarps due to the tents' flooring and heavier structural components. Moreover, single-wall tents tend to be known for condensation problems, where exhaled and evaporated moisture from the occupants condenses on the inner surface of the fabric and either drips or runs down the walls onto the floor. Solutions to the condensation problem such as inner wicking surfaces and vents tend to increase weight, and have limits in certain environmental conditions.

Other factors in choosing a tarp shelter over a tent seem to be the preference among many hikers for a more open, airy, close-to-nature experience while sheltering and sleeping outdoors, and the absence of any need to care for and keep clean an attached floor. The primary drawbacks of tarp shelters are their lack of peripheral weatherproofness, their reduced structural stability in wind, and their lack of insect protection as they are typically floorless and without insect netting.

A hybrid solution to the foregoing problems has been to apply netting in some fashion to tarp style shelters, with mixed success. Detachable netting inserts, defining floored or floorless screened enclosures within the protective tarp canopy, tend to add undesirable weight back into the system. Fixed netting sewn along the tarp perimeter and hanging to the ground provides some protection, but the lack of tensioning and supporting structure in even a well-rigged tarp mitigates some of the benefit. And, finally, no matter how well done the netting arrangement, tarps simply lack the tent-like structural strength and protection that many hikers find preferable.

An early solution to the foregoing problems was my original Tarptent™ shelter. This shelter combined features of tarps and tents, with a pole-supported, tensioned, tent-style waterproof canopy using lightweight material, and front and rear doors and a sidewall made from insect netting to reduce condensation and provide bug protection.

A second version of the Tarptent™ shelter was offered with improved structural strength using a catenary tensioned ridgeline and a tensioned rear arch pole in place of the previous upright rear pole. The rear arch was staked out with a single stake anchoring three tensioned guylines running from a rear arch awning.

Another class of tents is characterized by arched or hooped pole supports at each end. In these tents the tent fabric body is tensioned over two or more supportive hoops or arches like a tunnel. Where the tents are single-wall models, proper venting of the tent interior is important to prevent condensation from gathering on the walls and running to the floor. For example, the "Den" model tent available from Golite, LLC, believed to be the subject of U.S. Patent Application Publication No. 2001/0042563 A1 published Nov. 22, 2001, is a floored, solid-walled, arch-supported tunnel style tent with a higher front arch door and a lower rear arch door with insect netting door panels to provide through-ventilation. Rain protection for the front and rear doors can be achieved with waterproof fabric panels selectively opened to permit venting through the insect netting panels, but since the waterproof door panels inhibit ventilation, primary rain protection apparently relies on the front and rear arches being angled outwardly away from the canopy and floor to overlie the exposed netting door panels. The user is instructed in commercial publications to position the lower rear end into an oncoming wind to reduce condensation; otherwise, for potentially humid and/or still conditions the user seems to be advised to consider other styles of tent.

BRIEF SUMMARY OF THE INVENTION

The invention is an improved structure for nominally floorless canopy shelters, with a lower, outwardly-angled rear arch support tensioning a catenary ridgeline against a higher, vertical front arch support. By "nominally floorless" is meant shelters with a raised-off-the-ground, tensioned canopy structure where a floor is either absent, or is attached to but not structurally part of the raised, tensioned canopy structure.

The vertical front arch uses a fabric geometry at the front edge of the canopy and a tension distribution along the arch support for a vertical arch that properly tensions the catenary ridgeline. The front arch pole is tensioned with spaced guylines through a front awning structure which functions as an extension of the tensioned canopy through the arch. In a preferred form the guyline positioning on the awning causes intermediate portions of the front arch pole to bow outwardly while the apex and ends of the pole remain in a substantially vertical plane.

In a further form of the invention the front awning structure extends to the lower edge of the canopy sidewall and is downwardly-angled to provide both a high degree of weather protection for the vertical front door and secure, uniform tensioning of the vertical front arch support. The front awning may be split, and can be partially and fully rolled up to permit convenient access to the interior of the shelter through the vertical front door and to increase ventilation on one or both sides of the door. The front awning tensions the canopy and front arch equally well in both the extended and rolled up conditions through guyline attachment points or "pullouts" embedded in the awning fabric between the arch and the edge of the awning. In a preferred form the pullouts also secure rolled up portions of the awning.

Another aspect of the invention is the provision of stowable weather flaps along the raised-off-the-ground side edges of the shelter canopy. The weather flaps can be variably raised and lowered along the length of the canopy to adjust airflow and protection. In a preferred form the weather flaps can be tensioned to the front and rear arch support poles to increase structural stability.

Yet another feature of the invention is an axial guyline arrangement for tensioning the shelter on its long axis without the need for horizontal stakeouts or guylines and without obstructing access to the front door.

These and other features and advantages of the invention will become apparent from further reading of the specification in light of the accompanying drawings.

DETAILED DESCRIPTION OF THE INVENTION

Figure 1:
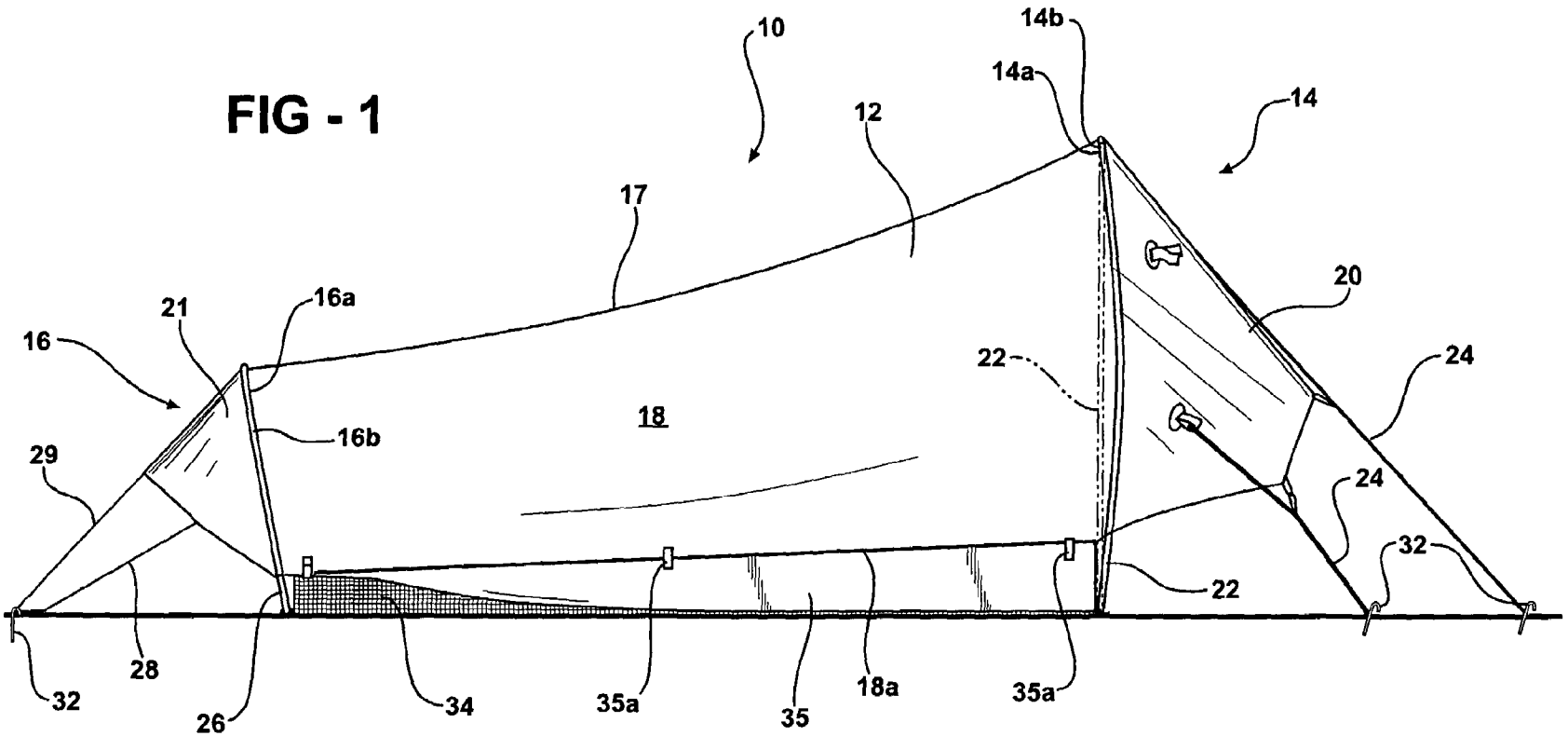
FIG. 1 is a side elevation view of a shelter according to the present invention.

Referring first to FIG. 1, a shelter 10 according to the invention has a waterproof canopy 12 made from a lightweight material commonly used for tents and tarps such as coated or treated nylon or polyester. While a waterproof material is preferred for such shelters, it will be understood by those skilled in the art that the degree of waterproofness can vary, and that for some uses water-resistant, wind-resistant, or sun-blocking materials that are not fully waterproof may be useful. In the illustrated embodiment the canopy material is a lightweight siliconized nylon weighing less than two ounces per square yard.

Shelter 10 has a front end 14 defined generally by front edge 14*a* of canopy 12, a rear end 16 generally defined by rear canopy edge 16*a*, a ridgeline 17, sidewalls 18 ending at canopy side edges 18*a*, a front awning 20, and a rear awning 21.

The front end of the canopy is raised and tensioned on a vertical arch support 22, and the rear end of the canopy is raised and tensioned on an outwardly-cantilevered arch support 26. Canopy tension and structure are maintained by guying out the front and rear supports 22 and 26 longitudinally through the awnings, in the illustrated embodiment with three spaced parallel guylines 24 at the front, and with a three-to-one converging guyline structure 28, 29 at the rear. The guylines are preferably secured to the ground with stakes 32, although they can also be secured to shrubs, trees, rocks and other available anchor points in known manner.

In the illustrated embodiment, front arch support 22 and rear arch support 26 are lightweight, hollow, flexible aluminum poles of a type commonly used for tents, preferably collapsible into joined sections for compact carry. Both arch poles may be formed with some or all of their sections pre-curved. It will be understood that other materials and structures can be used for the front and rear arch supports, one known alternative being fiber-resin composite poles or rods, although hollow aluminum poles are currently believed to be the most practical and economical.

Once canopy 12 is supported and tensioned on poles 22 and 26, it forms a stable, taut, floorless shelter structure with the canopy edges raised off the ground. The falling catenary ridgeline 17, dropping from the apex of the arch at front end 14 to the lower, rearwardly-angled arch at rear end 16, causes the ridgeline and sidewalls to be evenly tensioned and essentially wrinkle-free, giving the shelter strength, sag resistance, and wind-shedding ability. Canopy 12 therefore floats above the ground with stability more like that of a tent or a rigid structure than a tarp. Ridgeline 17 is a true catenary curve, defined by the well-known hyperbolic catenary curve equation created to describe the curve naturally taken by a homogeneous cable suspended by its ends.

Unlike many tarp shelters, the side edges of the canopy preferably run essentially straight (viewed in side elevation), offering better weather protection and in most conditions not needing additional staking for stability. For high side winds, one or more extra pullout points or guylines can be spaced along the canopy side edges 18*a* and used as needed.

The spacing of canopy 12 above the ground when properly erected can vary, although a preferred distance along the sidewall edges 18*a* in the illustrated embodiment is about eight inches at front end 14, tapering to about half that at rear end 16. The peak height at the front end in the illustrated embodiment is about 41" (inches), at the apex of the rear arch about 21.5" (inches). Width of the shelter at front end 14 is about 70" (inches), at rear end 16 about 51" (inches), and the total shelter length is about 93" (inches). It will be understood that these are preferred dimensions for the particular two-man ultralight model shown in the illustrated embodiment, and that they can vary relative to one another or overall, depending on the desired size of the shelter, the premium placed on light weight versus space and headroom, and other factors that will be recognized by those skilled in the art.

Canopy 12 is provided with a drop-down netting perimeter for insect protection, and additionally for protection against blowing rain, sand and snow. Netting sidewalls 34 hang from canopy sidewall edges 18*a* to the ground, a netting end panel 36 (FIG. 3) hangs from rear canopy edge 16*a* to the ground, and a netting door 38 (FIG. 2) hangs from front canopy edge 14*a* to the ground. Door 38 is preferably divided or otherwise able to be opened or parted, for example with a zipper 38*a* for ease of entry and exit. End panel 36 can be fashioned as a secondary door, if desired, although the low height of rear canopy end 16 makes this less convenient.

Figure 3:
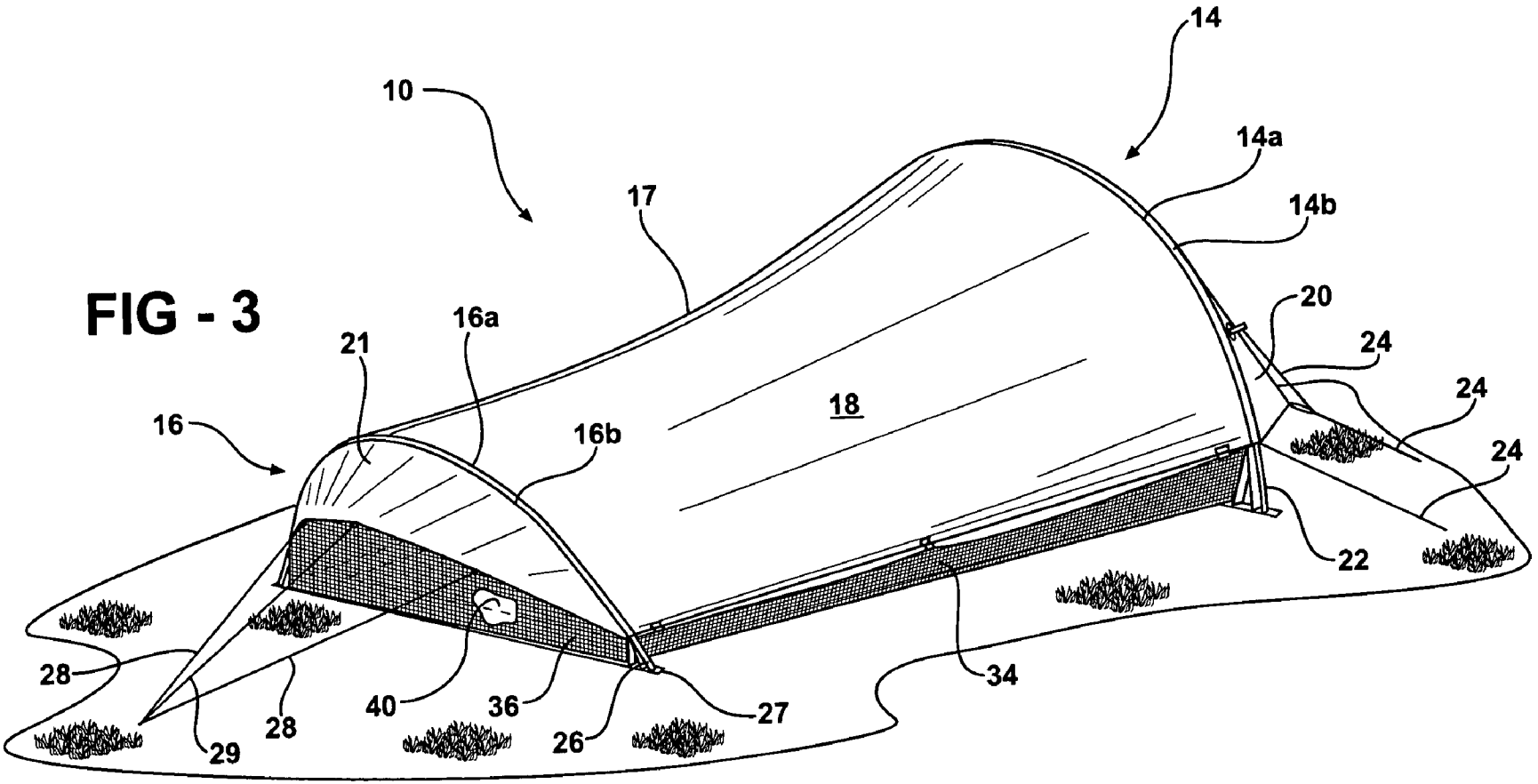
FIG. 3 is a rear perspective view of the shelter of FIG. 1.
Figure 5:
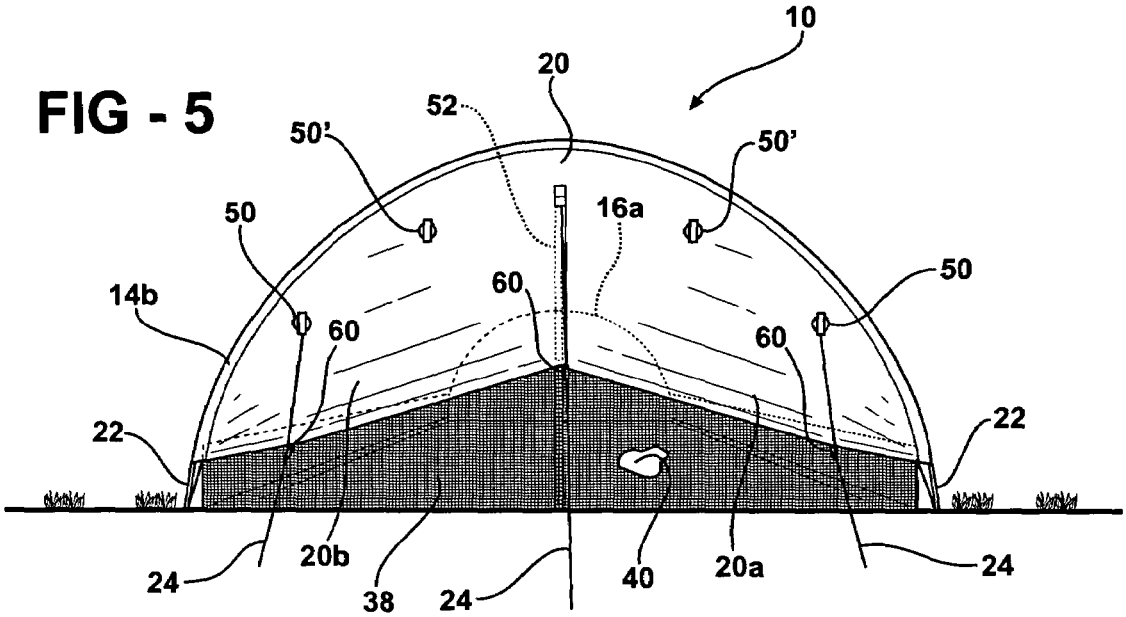
FIG. 5 is a front elevation view of the shelter of FIG. 1, with the awning fully extended.

Shelter 10 is designed to be nominally floorless, as best shown in FIGS. 3 and 5, with the ground-engaging netting perimeter defining a bare-ground footprint 40 under the canopy for sleeping and gear storage. The netting may be designed to hang just to the ground at an optimum canopy height, or can be provided with extra length to permit canopy height adjustment while maintaining insect protection. In the preferred embodiment illustrated, the lower edge of the netting perimeter forms a horizontal flap along the sidewalls and front and rear panels designed to extend inwardly on the ground for at least several inches to provide a place to anchor the free-hanging netting with rocks, gear, sleeping bags, stakes, and such; or to allow a removable groundcloth to be overlapped with the netting for increased insect protection; or to provide an attachment point for an optional floor.

Figure 4:
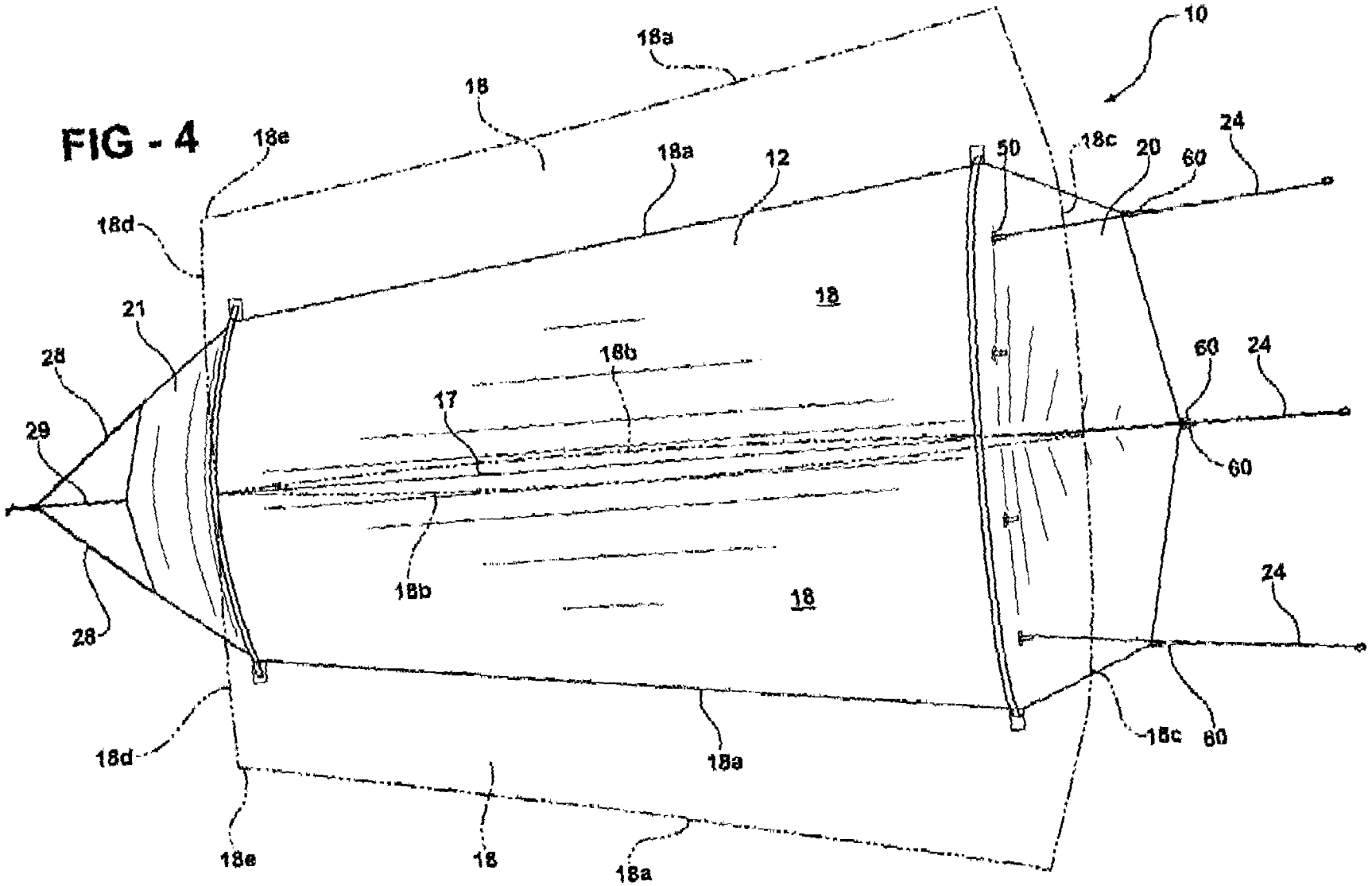
FIG. 4 is a top plan view of the shelter of FIG. 1, with the canopy pattern superimposed in phantom in its flat condition.

FIG. 4 shows the pattern for canopy 12 superimposed in phantom over the erected shelter, and in particular shows that catenary ridgeline 17 is also a true ridgeline, formed by the joinder of two separate fabric panels 18 (sidewalls 18) along a center seam, in the illustrated embodiment a sewn seam. Each panel 18 has a catenary seam edge 18*b* that in the flat condition curves inwardly from the panel ends, away from the opposite panel's seam edge. Sidewall lower edges

18*a* are also preferably cut in a catenary fashion, with a mild concave curvature relative to the ridgeline as best seen in the flat phantom pattern for canopy 12. The ends 18*c* and 18*d* of each panel are angled inwardly toward one another relative to seam edge 18*b*, with front ends 18*c* having inner straight and outer curved portions, and rear ends 18*d* preferably having a slight convex curvature and a length requiring a short angled shoulder 18*e* where side edge 18*a* joins rear end 18*d*. This configuration results in a vertical front arch and an outwardly-cantilevered rear arch when the shelter is erected with tension sufficient to make ridgeline 17 taut. This configuration also allows the front and rear edges of the shelter canopy (formed by the front and rear ends 18*c* and 18*d* of the joined canopy panels) to be folded over and sewn or otherwise secured to form essentially straight sleeves for arched poles 22 and 26, which in turn allows the front and rear awnings 20 and 21 and canopy 12 to be evenly tensioned by the spaced guylines 24 and 28.

The preferred angle for the rear arch in the illustrated embodiment is about 12° (degrees) from vertical. It will be understood by those skilled at setting up tents that minor variations will occur with respect to the vertical orientation of the front arch and the outward cant of the rear arch among different users and even for the same user, and that although true vertical for the front arch and a twelve degree outward cant for the rear arch are the ideal, variations due to "eyeballing" the shelter setup in real life conditions will occur. The shelter will be most taut and weather-worthy when the ideal is achieved on setup.

Figure 2:
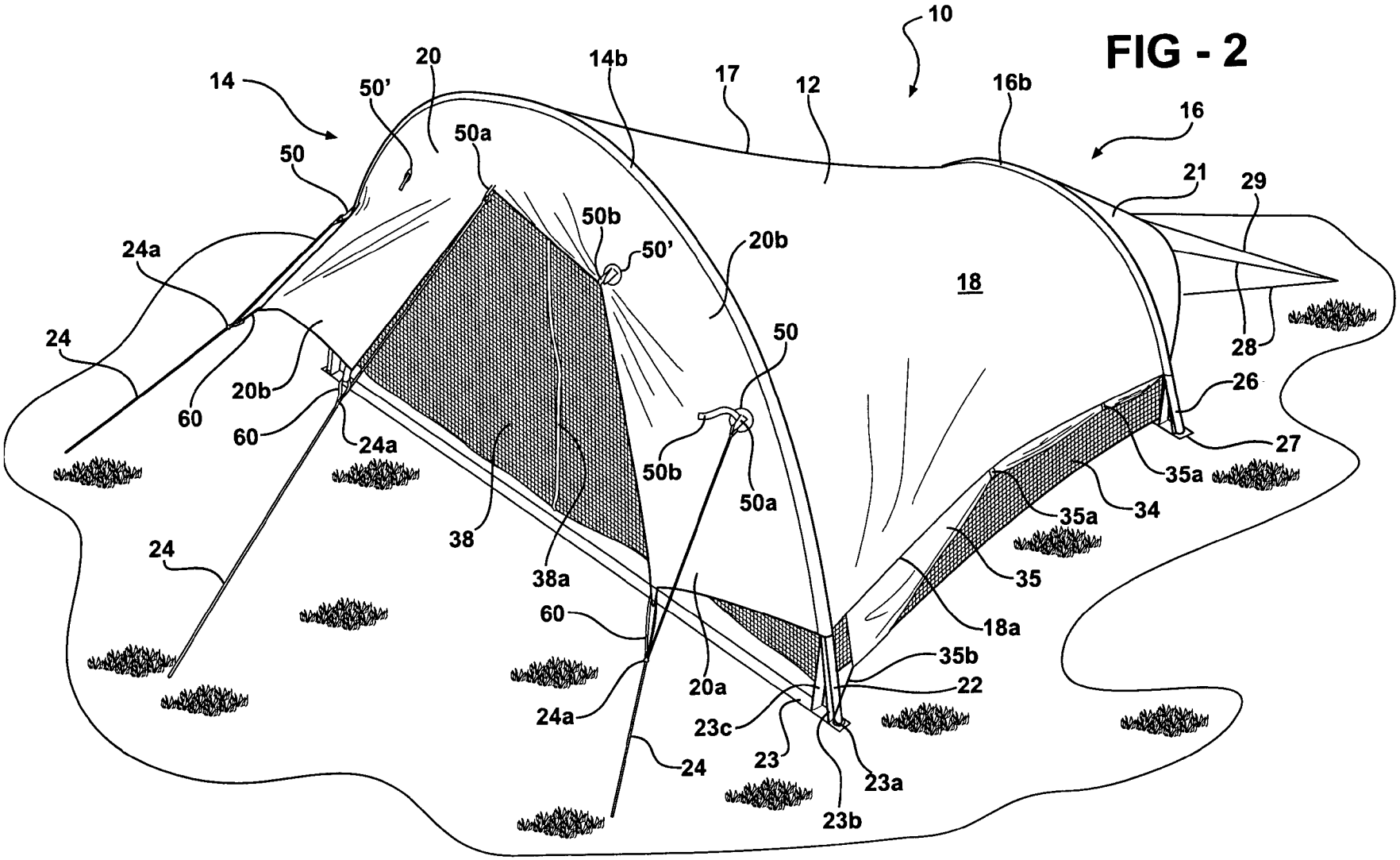
FIG. 2 is a perspective front view of the shelter of FIG. 1, with a portion of the front awning shown rolled up.

FIGS. 2 through 4 illustrate the details of the front and rear arch supports and awning structures, and of a novel guyline arrangement allowing spaced axial guylines at each end of the shelter to fully support the shelter on its longitudinal axis without the need for lateral staking or guying, and with a minimum "footprint" of ground space taken up by the shelter and the necessary guylines.

Figure 3A:
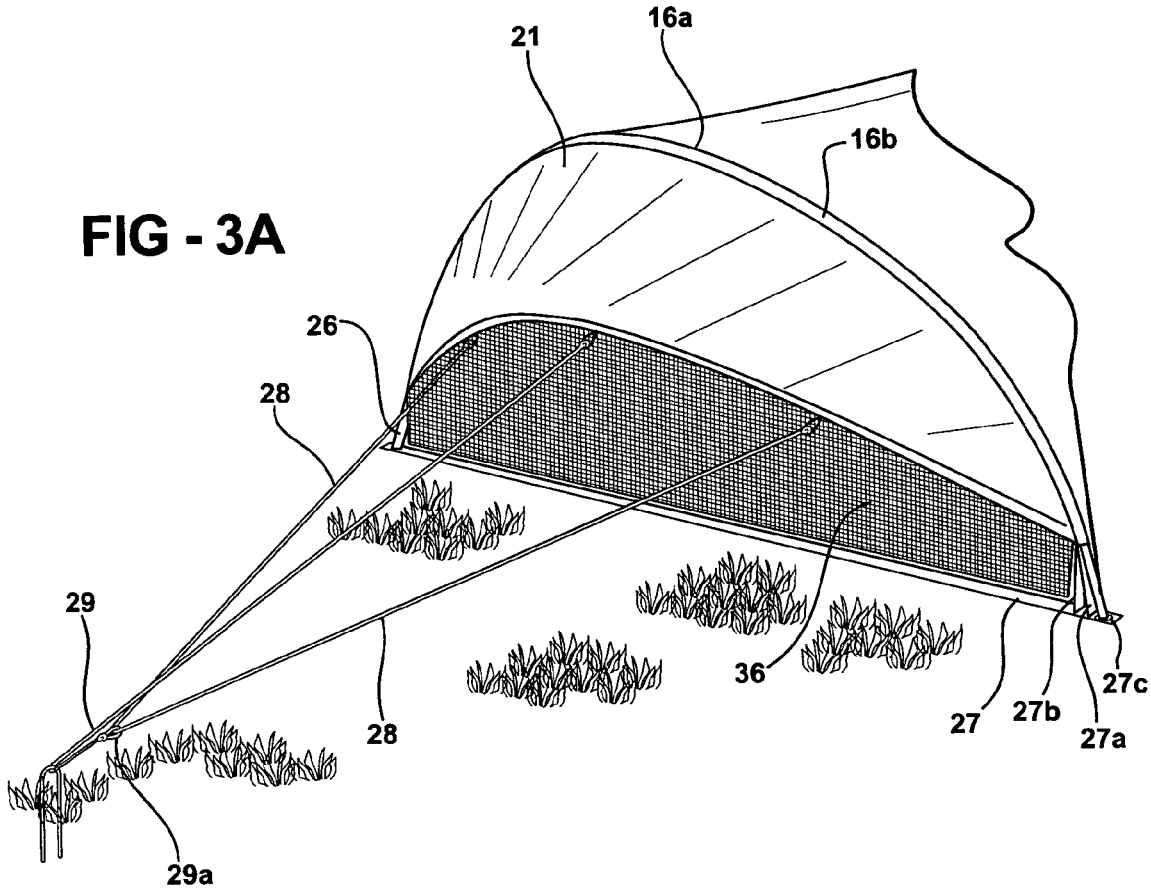
FIG. 3A is a detailed perspective view of the rear end of the shelter from FIG. 3.

Referring first to FIGS. 3 and 3A, the rear arch support and awning structure is the same as that disclosed in my co-pending U.S. patent application Ser. No. 10/673,285 entitled "Lightweight Shelter", with the same inventor and filing date as the present application. The three spaced rear guylines 28, 29 preferably converge from the edge of rear awning 21 in a manner allowing them to be staked out with a single stake in a single step. Rear edge 16*a* of canopy 12 has a pole-securing structure such as a continuous sleeve 16*b* for pole 26, the pole being removably inserted in the sleeve in known fashion, and long enough that its ends protrude from each end of the sleeve once inserted. A lateral tension strap 27 is spaced from and connected to the ends of sleeve 26*a* with short connector straps 27*a* and 27*b* forming a triangle, each end of tension strap 27 having a pole-receiving grommet 27*c*. When the ends of pole 26 are inserted in the grommets, the tension from the curve of the pole and from the rear edge of the canopy pull strap 27 to its maximum width, locking pole 26 and the rear of the canopy into its arched structure.

Rear awning 21 is connected to the rear edge of the canopy, for example at sleeve 16*b* by sewing, extending along at least a major portion of the arch to overlie at least a major portion of rear netting panel 36, which is connected to and hangs down from the inside of the rear edge 16*a* of the canopy. In the preferred embodiment illustrated, awning 21 is coextensive with the rear edge 16*a* of canopy 12, effectively forming a continuous tensioned extension of the rear end of canopy 12 through the arch support. Awning 21 has an acute downward angle relative to the plane of the arch. Awning 21 extends a greater distance from the canopy at its center, and is preferably tapered inwardly toward the sleeve ends on either side, generally following the sweep of the arc of pole 26.

Guyline structure 28 comprises three spaced guylines 28 and 29 secured to and extending from the rear edge of awning 21, converging to a single stakeout point as shown in FIG. 3. In the preferred embodiment illustrated, guylines 28 are formed by a single loop of cord secured at either end to the opposite sides of rear awning 21, and bisected by shorter, straight center guyline 29 attached to the center of awning 21 at one end and to the middle of cord 28. Center line 29 is preferably slidably connected to cord 28, for example with a simple knotted loop as shown, or with a sliding clip, hook, or the like. The length of center line 29 is longer than the maximum tensioning distance from the center edge of awning 21 to the apex of the "V" of fully tensioned cord 28. Staking out and tensioning the guylines is accordingly accomplished in a single step by hooking or looping an intermediate portion of center line 29 and staking it down rearwardly beyond the sliding junction of center line 29 with cord 28, as shown. Tension can be adjusted left and right on the awning by sliding center line 29 along cord 28, and back and forth simply by moving the single stake toward or away from the tent.

Referring next to FIGS. 2 and 4, the details of the illustrated front arch and awning are now described. Front arch pole 22 supports canopy 12 at front edge 14*a* through sleeve 14*b* in essentially the same manner as rear pole 26 in sleeve 16*b* at rear edge 16*a*. The protruding ends of pole 22 are secured in the arch configuration by inserting them in grommeted ends 23*a* of a lateral tension strap 23 extending across and secured to the front end of the shelter by connector straps 23*b*, 23*c* secured to the sleeve ends. The front arch pole is tensioned with spaced guylines 24 through front awning 20, whose inner end is preferably coextensive with the front edge of canopy 12, extending down to canopy sidewall edge 18*a* on each side of the door, effectively forming a continuous tensioned extension of canopy 12 through the front arch support pole and sleeve.

Awning 20 is angled downwardly at an acute angle from the front arch to provide a high degree of weather protection around the perimeter of the door, as well as secure tensioning for the vertical front door and arch support. The front awning 20 can be partially and fully rolled up to permit convenient access to the interior of the shelter through the vertical front door and to increase ventilation on one or both sides of the door. The front awning is also capable of tensioning the canopy and front arch in both the extended and rolled up conditions through "embedded" guyline attachment or pullout points 50 secured to the awning fabric between the arch and the outer edge of the awning. In the illustrated embodiment pullouts points 50 are reinforced fabric patches with sewn-in loops 50*a* for attaching guylines 24. Pullouts 50 are located closer to the front arch than to the outer edge of the awning, and in a preferred form the pullouts also include fasteners such as hook-and-loop strips 50*b* or cord-and-toggle closures on the inner and outer faces of the awning to secure rolled up portions of the awning.

The vertical front arch support uses a curved fabric geometry at the front edge 14*a* of canopy 12 (front edges 18*c* in FIG. 4) to accommodate a natural tension distribution along the flexed arch pole 22 through awning 20 and sleeve 14*b* to form an arched pole sleeve under tension that is compatible with the catenary ridgeline. Together with the lightweight pole, and the somewhat elastic nature of the nylon canopy and awning material, the circumferential point tensioning of the awning through pullouts 50 tends to cause a bending or bowing of intermediate portions of the front arch pole while the apex and ends of the pole remain in a substantially vertical plane (see FIG. 1, with the ideal vertical orientation of the arch shown in phantom). The curvature of the front edge of the canopy pattern uniformly transfers the tension from the flexed arch to the sidewalls. This results in a strong, taut, vertical arch structure.

FIG. 4 illustrates the axial guyline arrangement of shelter 10, where both the front and rear guylines extend from the front and rear ends of the shelter generally longitudinally, remaining within a path or area corresponding to the width of the arch supports through which they longitudinally tension the shelter. The guylines may be arranged to ultimately converge as at rear end 16, or to remain parallel or diverge as shown at front end 14 with guylines 24, but in both cases they lie mostly or entirely within the longitudinal path of the shelter and its arch supports.

Referring next to FIGS. 2 and 5, front awning 20 is preferably split down the center into right and left halves 20*a* and 20*b*. The adjoining edges of the awning halves are releasably secured to one another with known fasteners such as mating hook-and-loop strips 52 or a zipper. The split extends only to the pullout points 50, leaving the awning material between the pullouts and the arch a solid, unbroken web of fabric as best shown in FIG. 5B. The outer edges of the awning halves are in turn releasably connected and tensioned to guylines 24, in the illustrated embodiment with elastic cords 60 secured to the outer edge of the awning and releasably connected to intermediate portions 24*a* of the guylines using clips, knotted loops, or similar structure that allows cords 60 to be conveniently attached and detached from predetermined points on the guylines. Cords 60 are preferably connected to the guylines at an angle as illustrated. The lateral component of tension created by cords 60 between the awning fabric and the guylines causes some off-axis displacement of the guylines as illustrated in FIGS. 2, 5, and 5A, and further tensions the outer edge of the awning to prevent flapping when fully extended in windy weather.

Figure 5A:
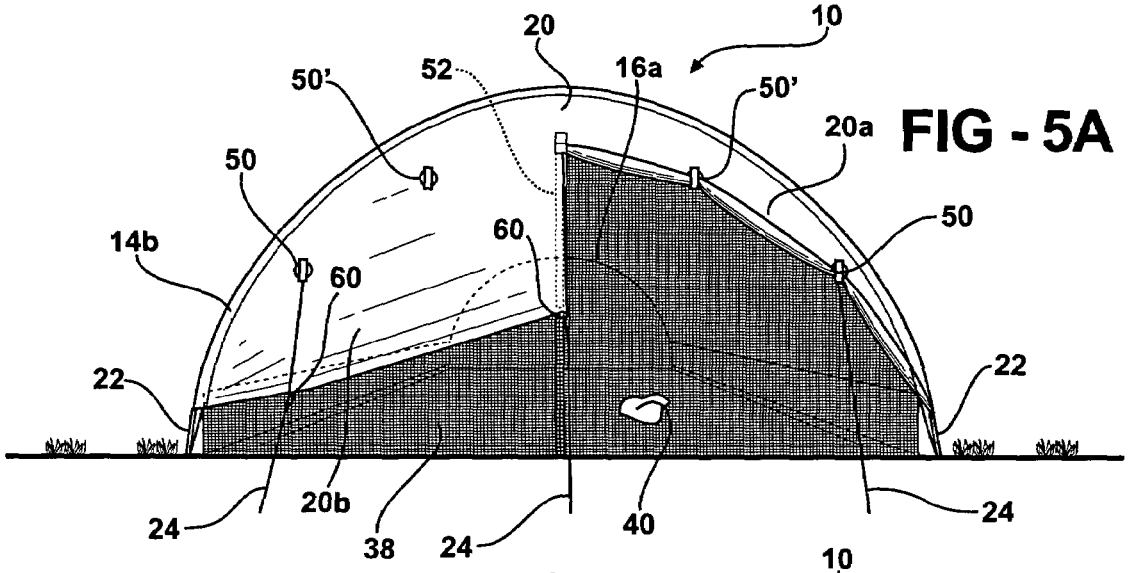
FIG. 5A is similar to FIG. 5, but with one side of the awning fully rolled up.
Figure 5B:
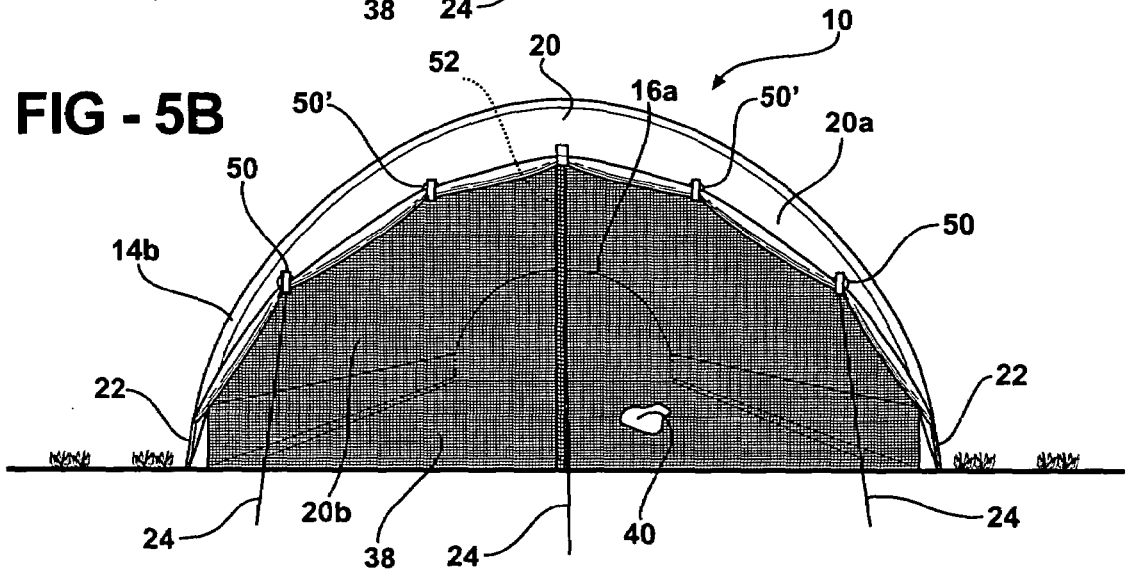
FIG. 5B is similar to FIG. 5, but with both sides of the awning fully rolled up.

Each awning half 20*a*, 20*b* can be partially or fully rolled up as shown in FIGS. 2, 5A, and 5B, to provide several ventilation and view (or weather protection and privacy) options from each side of the front of the shelter. The tension exerted on the front arch through awning 20 by guylines 24 remains constant and evenly distributed regardless of the rollup option chosen.

Referring to FIGS. 1 and 2, shelter 10 also includes an adjustable side protection and ventilation structure, with a stowable side panels 35 hanging from sidewall edges 18*a* of canopy 12 over netting side panels 34. Side panels 35 are preferably made from the same material as canopy 12, and can be rolled up and secured with one or more loops, toggles, clips, tieouts 35*a* or the like spaced along the lower edges of canopy sidewalls 18. In the preferred form there are multiple tie-offs along each side, allowing panels 35 to be rolled up in increments along the length of the shelter. Panels 35 also preferably include structure such as elastic loops 35*b* at their front and rear corners, so that they can be secured and preferably tensioned to the ends of the arch poles, thereby preventing panels 35 from flapping in the wind, and further tensioning canopy 12 along its lower edges.

It will be apparent to those skilled in the art that the foregoing preferred embodiments of a shelter according to the invention are examples only, and that shelters within the scope of the invention as defined by the claims below may vary in their construction details, materials, dimensions and other respects and equivalents now that I have disclosed the invention by these examples.

I accordingly claim:

1. An improved structure for a nominally floorless hikers' shelter having a raised, tensioned waterproof canopy supported at a front end and at a rear end by pole structure, comprising:

a shelter canopy comprising a catenary ridgeline tensioned between a higher, vertical front arch support and a lower, outwardly-angled rear arch support, wherein the front and rear arch supports are tensioned by downwardly angled front and rear awnings that form tensioned extensions of the canopy through the arch supports, and wherein the front awning is circumferentially coextensive with the canopy at the front arch support, the front awning extending downwardly and forwardly to a lower edge raised off the ground when the shelter canopy is raised off the ground, the front awning being exclusive weather protection for a screened but otherwise unprotected vertical shelter door defined by the vertical front arch support.

2. The shelter structure of claim 1, wherein the front and rear awnings are tensioned longitudinally by a plurality of spaced guylines extending axially from the front and rear awnings.

3. The shelter structure of claim 1, wherein the rear awning is circumferentially coextensive with the canopy at the rear arch support.

4. The shelter structure of claim 1, wherein the shelter canopy has an insect netting perimeter hanging from raised rear and side edges of the canopy to the ground.

5. The shelter structure of claim 1, wherein the rear arch support includes a rear awning, the rear arch support being cantilevered outwardly and downwardly from the shelter canopy at a first acute angle, and the rear awning being angled downwardly from the rear arch support at a second greater acute angle, and wherein the front arch support includes a front awning angled downwardly at an acute angle to the vertical front support.

6. The shelter structure of claim 5, wherein the front and rear arch supports are tensioned through the front and rear awnings by spaced guylines extending axially from the awnings.

7. The shelter structure of claim 1, wherein the shelter canopy further comprises sidewall edges raised off the ground when the shelter canopy is raised off the ground on the front and rear arch supports, and insect netting hanging from the sidewall edges to the ground, and solid fabric side panels connected to the lower sidewall edges and movable between a rolled up storage position leaving the insect netting exposed, and a lowered position covering the insect netting for weather protection, the side panels further comprising releasable tensioned connections at front and rear ends thereof to the front and rear arch supports.

8. An improved structure for a nominally floorless hikers' shelter having a raised, tensioned waterproof canopy supported at a front end and at a rear end by pole structure, comprising:

a shelter canopy comprising a catenary ridgeline tensioned between a higher, vertical front arch support and a lower, outwardly-angled rear arch support, wherein the front and rear arch supports are tensioned longitudinally by downwardly angled front and rear awnings that form tensioned extensions of the canopy through the arch supports, wherein the front and rear awnings are tensioned longitudinally by a plurality of spaced guylines extending from the front and rear awnings, the front awning extending downwardly and forwardly to a lower edge raised off the ground when the shelter canopy is raised off the ground, and wherein the guylines from the front awning are attached to the front awning at spaced pullout points between the front arch support and the lower edge of the front awning.

9. The shelter structure of claim 8, wherein the lower edge of the front awning is releasably connectable to one or more of the guylines.

10. The shelter structure of claim 8, wherein the lower edge of the awning can be rolled up to the spaced pullout points where the guylines are attached.

11. The shelter structure of claim 10, wherein the awning includes means for securing rolled up portions of the awning.

12. The shelter structure of claim 11, wherein the spaced pullout points include means for securing rolled up portions of the awning.

13. The shelter structure of claim 8, wherein the awning is split, the split being closeable and extending from the lower edge of the awning to a location at or below the spaced pullout points where the guylines are attached.

14. The shelter structure of claim 13, wherein the awning includes means for securing rolled up portions of the split awning.

15. The shelter structure of claim 14, wherein the spaced pullout points include means for securing rolled up portions of the split awning.

16. The shelter structure of claim 14, wherein the awning includes circumferentially spaced means for selectively securing portions of the split portions of the awning.

17. The shelter structure of claim 8, wherein the front awning is circumferentially coextensive with the canopy at the front arch support.

18. The shelter structure of claim 8, wherein the front awning between the spaced pullout points and the front arch support comprises a solid web of fabric, and the front awning is further split with a closable opening from a lower outer edge of the front awning to the spaced pullout points.

19. The shelter structure of claim 18, wherein the spaced pullout points are arranged in a curved pattern corresponding to and spaced from the front arch support.

20. The shelter structure of claim 19, wherein the spaced pullout points are located closer to the front arch support than to the lower outer edge of the front awning.

* * * * *